US009932744B2

(12) United States Patent
Vandenberg

(10) Patent No.: US 9,932,744 B2
(45) Date of Patent: Apr. 3, 2018

(54) CARPENTRY TOOL

(71) Applicant: National Nail Corp., Grand Rapids, MI (US)

(72) Inventor: Roger A. Vandenberg, Hudsonville, MI (US)

(73) Assignee: National Nail Corp., Grand Rapids, MI (US)

( * ) Notice: Subject to any disclaimer, the term of this patent is extended or adjusted under 35 U.S.C. 154(b) by 330 days.

(21) Appl. No.: 14/701,550

(22) Filed: May 1, 2015

(65) Prior Publication Data

US 2015/0345156 A1 Dec. 3, 2015

Related U.S. Application Data

(60) Provisional application No. 62/003,280, filed on May 27, 2014.

(51) Int. Cl.

| | |
|---|---|
| ***E04F 21/22*** | (2006.01) |
| ***E04F 21/18*** | (2006.01) |
| ***B25B 5/08*** | (2006.01) |

(52) U.S. Cl.

CPC ..... *E04F 21/22* (2013.01); *B25B 5/08* (2013.01); *E04F 21/1855* (2013.01)

(58) Field of Classification Search

CPC ..... E04F 21/22; B25B 5/08
USPC ..... 269/71, 229, 231
See application file for complete search history.

(56) References Cited

U.S. PATENT DOCUMENTS

| | | | | |
|---|---|---|---|---|
| 77,610 | A | 5/1868 | Hall | |
| 371,169 | A | 10/1887 | Brown et al. | |
| 389,919 | A * | 9/1888 | Boettner | E04F 21/22 254/16 |
| 608,458 | A * | 8/1898 | Ingersoll | E04F 21/22 254/16 |
| 618,573 | A * | 1/1899 | Ingersoll | E04F 21/22 254/16 |
| 1,283,209 | A * | 10/1918 | Kimble | E04F 21/22 254/15 |
| 5,139,231 | A | 8/1992 | Temple | |
| 5,248,127 | A | 9/1993 | Young | |
| 5,269,494 | A * | 12/1993 | Pittman | E04F 21/22 254/17 |
| D353,987 | S | 1/1995 | Pasto | |

(Continued)

*Primary Examiner* — Christopher M Koehler
*Assistant Examiner* — Seahee Yoon
(74) *Attorney, Agent, or Firm* — Warner Norcross and Judd, LLP

(57) ABSTRACT

A carpentry tool for pushing deck, flooring or other boards toward one another on a joist or underlying substructure. The tool can be operated with one hand, leaving the other hand free for installation of a fastener. The tool can leave an area adjacent the joist and board exposed so that a fastener can be installed in the board and joist in that area. The tool can include a pusher cam rotatably joined with a base, and fixedly joined with a lever. A joist cam and joist blade can be joined with the base, disposed opposite one another across a variable width joist recess. The pusher cam and joist cam can be mechanically coupled to the base so that rotation of the pusher cam urges rotation of the joist cam, thereby causing the joist cam to dynamically grip the joist and prevent the tool from rocking and/or moving away from the pushed board.

19 Claims, 11 Drawing Sheets

(56) References Cited

U.S. PATENT DOCUMENTS

| | | | | |
|---|---|---|---|---|
| 5,456,053 | A * | 10/1995 | Fischer | E04F 21/22 254/113 |
| 5,527,014 | A * | 6/1996 | Bracewell | E04F 21/22 254/15 |
| 5,605,319 | A * | 2/1997 | Reiley | E04F 21/22 254/17 |
| 5,826,858 | A | 10/1998 | Gordon | |
| 6,616,132 | B1 * | 9/2003 | Ellison | E04F 21/22 269/15 |
| D623,913 | S | 9/2010 | Pele | |
| D663,612 | S | 7/2012 | Pele | |
| D665,657 | S | 8/2012 | Pele | |
| 8,464,488 | B2 | 6/2013 | Pele, Jr. | |
| 2005/0247019 | A1 * | 11/2005 | Pasto | E04F 21/22 52/749.12 |
| 2010/0180986 | A1 | 7/2010 | Pele, Jr. | |
| 2011/0274515 | A1 | 11/2011 | Pele, Jr. | |
| 2013/0247504 | A1 | 9/2013 | Pele et al. | |

* cited by examiner

CARPENTRY TOOL

BACKGROUND OF THE INVENTION

The present invention relates to a carpentry tool and, more particularly, to a tool adapted to push or move parallel boards together in decks, flooring and other structures.

There are many conventional tools utilized for pushing deck or flooring boards into parallel contact before nailing the boards to a joist. Such tools are illustrated in U.S. Pat. No. 5,826,858 to Gordon, U.S. Pat. No. 5,248,127 to Young and U.S. Pat. No. 5,269,494 to Pittman.

Conventional tools have various drawbacks. Most are configured so that they push the boards immediately adjacent one another. Where a gap between boards is desired, it may be hard to achieve. Many tools cover a top of a joist immediately adjacent an outer edge of the board. Thus, hidden fasteners can be difficult to install in the edge or side of the board and underlying joist. Several tools require a user to use both hands to operate the tool, with another worker having to nail the boards to the underlying joist. Many conventional tools of the type described above are complex and expensive.

Accordingly, there remains room for improvement with regard to tools used to bend or otherwise place boards in a satisfactory position so that they can be secured to underlying joists or substructures.

SUMMARY OF THE INVENTION

A carpentry tool for pushing deck, flooring or other boards toward one another on a joist or underlying substructure as provided. The tool can include a base and a primary cam rotatably joined with the base. A lever can be joined with the primary cam. A secondary cam can be rotatably mounted to the base along with at least one other joist engaging element.

In one embodiment, the primary cam can be in the form of a pusher cam and the secondary cam can be in the form of a joist cam. The joist cam and the other joist engagement element can lay opposite one another, across an aperture configured to receive a joist, also referred to as a joist recess. Operation of the pusher cam to engage a board and move it can result in rotation and/or movement of the joist cam so that the joist cam and the other joist engaging element dynamically grip and/or bite into an underlying joist or substructure, optionally to prevent the tool from slipping or moving away from the board being pushed by the pusher cam.

In another embodiment, the pusher cam can include a rounded and/or angled board engaging surface. The board engaging surface can directly engage a board with a preselected force applied via the lever. With this construction, a user can apply a preselected force to the board, thereby moving it within preselected distance relative to an adjacent parallel board. In some instances, the user can use the mechanical advantage of the lever and pusher cam to selectively space the pushed board from another already installed board to establish a predetermined gap between the adjacent boards.

In still another embodiment, the pusher cam can be configured to rotate about a first pivot axis, and the joist cam can be configured to rotate about a second axis. These axes can be common, or they can be separated from one another by a preselected distance. Optionally, rotation of the pusher cam with the lever about the first axis in a first direction can result in or generate rotation of the joist cam about the second axis in an opposite direction. As an example, forcibly rotating the pusher cam clockwise when engaging a board can urge the joist cam to rotate counter-clockwise, thereby assisting in the gripping engagement of the joist cam with an underlying joist adjacent the joist cam.

In yet another embodiment, the joist cam can include an outer perimeter that is rounded, circular and/or elliptical. Optionally, the outer perimeter can include one or more teeth or projections. These projections can engage a joist and effectively bite into and grip it to prevent movement or rocking of the base relative to the board so that appropriate forces can be applied through the pusher cam.

In even another embodiment, the other joist engaging element can be in the form of a blade or edge that runs generally horizontal relative to a joist when the tool is in use. This blade can be sharpened so that it too bites into the joist when the pusher cam is moved.

In a further embodiment, the other joist engaging element, for example, the blade or edge, can be joined with a base element so that the edge is distal from the lower surface of the base. The edge can be elongated so that sufficient points of contact engage the joist to prevent the base and pusher cam from unintentionally moving out of alignment with a board that is being pushed using the tool.

In yet a further embodiment, the other joist engaging element can be in the form of one or more elongated cylinders, for example, bolts or screws projecting downward from the base.

In still a further embodiment, the pusher cam can be disposed above the base and the joist cam can be disposed below the base. In this manner, rotation of one of these elements does not interfere with the rotation of the other. Optionally, the tool can be configured so that rotation of the pusher cam results in an opposite rotation of the joist cam.

In yet a further embodiment, the tool can be reversible so that the pusher cam may be oriented to the left or to the right of a joist to effectively push a board. This can provide enhanced access and use of the tool, particularly where a joist is close to a wall and/or difficult to access.

In even a further embodiment, the base and/or pusher cam can include a locking element. The locking element can be configured to secure the pusher cam in a temporarily fixed orientation relative to the base. This can effectively lock a board being pushed with the tool in a fixed orientation. For example, the board can be pushed and fixed immediately adjacent and touching another parallel board. Alternatively, the board can be spaced a particular preselected distance from the adjacent board to establish a gap of preselected dimension. In either case, a user can install a fastener into the board and/or joist using both hands, with the tool being in a hands free configuration.

In yet a further embodiment, the base, pusher cam, joist cam and secondary joist engaging element can be configured so that the pusher cam can push a board while maintaining an area adjacent and above the joist of sufficient size for a user to install a fastener through the side, edge and/or a corner of the board being pushed by the pusher cam.

The current embodiments of the carpentry tool herein provide a simple and effective device that can be used to dynamically push and place boards, over joists, flooring and other substrates. The tool can be operated one handed so that a user is free to utilize another hand to install a fastener while a board is being pushed with the tool. Where the tool includes a lock element, or where the pusher cam and lever are fully rotated, both the user's hands can be free while the tool holds a board. Thus, the user can use both hands to install a fastener while the tool holds the board in a desired configuration. The tool also is able to fit different size joists yet still effectively lock the base and remainder of tool in fixed relation to the same as the pusher cam engages a board. The tool can provide variable clamping to effectively clamp or grip a joist and provide a solid foundation for pushing the board using the pusher cam. With the lock, and the configuration of the pusher cam relative to the base, a user can lock the pusher cam in a number of positions to provide a gap of various dimensions between adjacent boards. This can provide significant gap variability. Further, when the joist cam and secondary joist engaging element are included, these components can effectively lock the base and remainder of the tool in a relatively fixed position to prevent rocking of the tool when forces are applied to the pusher cam and the board being pushed.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
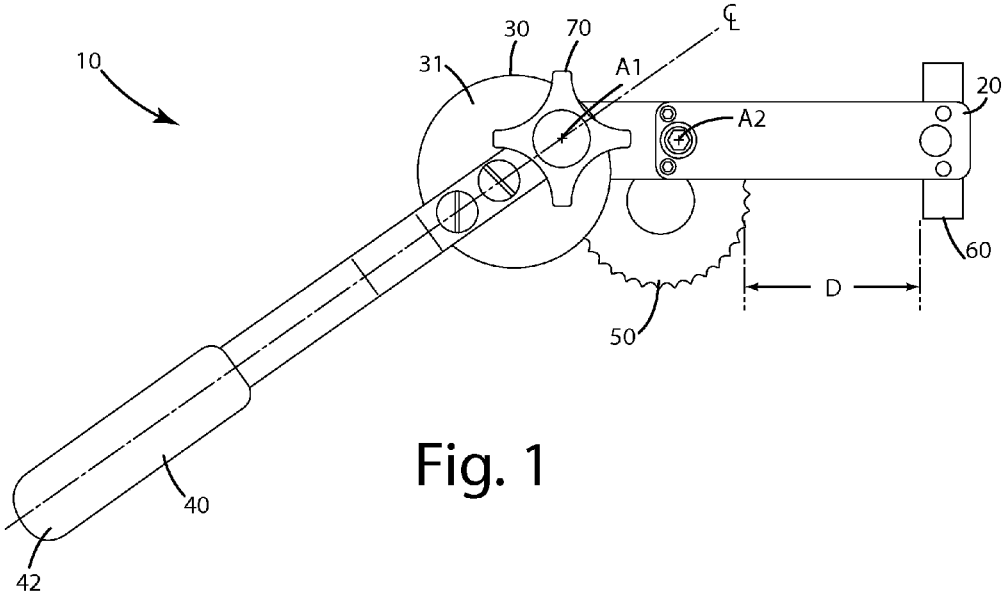
FIG. 1 is a top view of a carpentry tool of a current embodiment.
Figure 2:
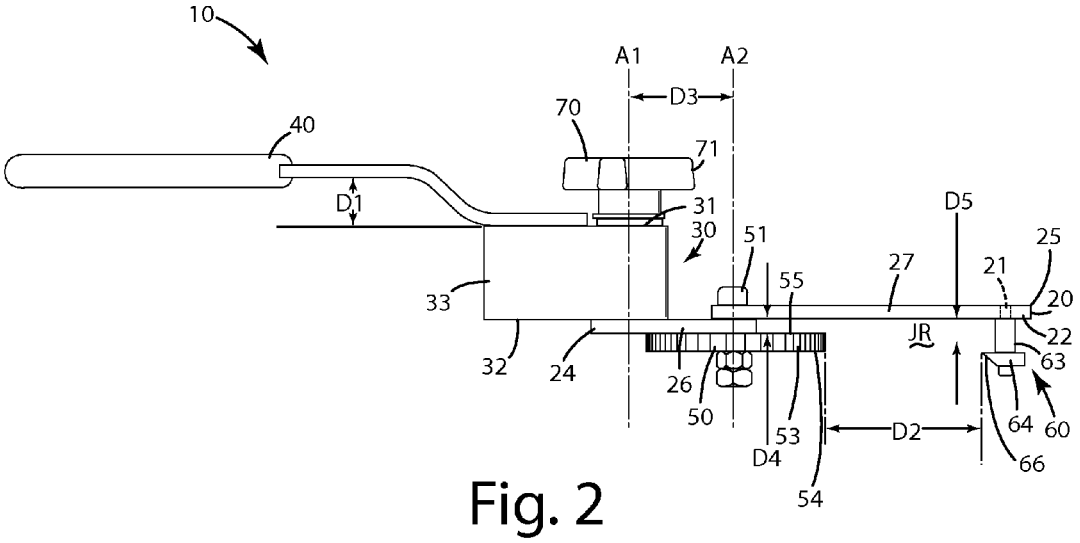
FIG. 2 is a side view of the carpentry tool.
Figure 3:
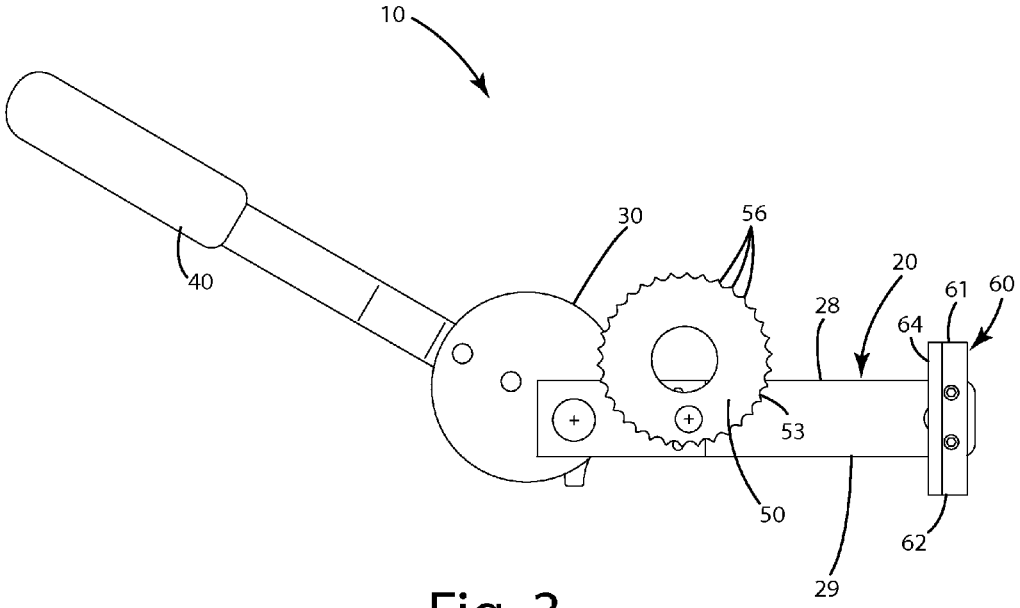
FIG. 3 is a bottom view of the carpentry tool.

A carpentry tool according to a current embodiment is illustrated in FIGS. 1-3 and generally designated 10. The carpentry tool can include a base 20 to which a pusher cam 30 is attached. A lever 40 can be attached to the pusher cam. A joist cam 50 can be joined with the base 20, opposite a secondary joist engaging element 60, across a joist recess. The pusher cam 30 includes an outer perimeter that can be angled and/or rounded, but configured to engage a board to be pushed as further described below. The joist cam 50, also referred to as a first or primary joist engaging element, can be spaced a dynamically adjustable distance D from the secondary joist engaging element 60. This distance D can correspond to the width of one or more joists or underlying substructures.

Although referred to as a "cam" herein, the pusher cam and joist cam herein can be of a variety of different shapes and sizes. Generally, the axis of rotation of these elements is offset from the geometric and/or center of mass of the same. As an example, the cam need not necessarily include an outer eccentrically shaped board engaging surface to still be called a cam. In some cases, the outer engaging surface can include multiple facets angled relative to one another as described above. Further, a "cam" can refer to a part of a rotating element designed to make sliding or other contact with another part or object while rotating. Additionally, as used herein, "board" can refer to wooden, composite, plastic, metal, hybrid and/or other types of elongated building materials or structures used in construction. A "joist" can refer to like constructed materials or structures. Typically, a board is placed over a joist and fastened thereto in the current embodiments.

Each of the components of the carpentry tool 10 will now be described. To begin, the pusher cam 30 is illustrated as a curved or rounded element. The pusher cam 30 can include an upper surface 31 and a lower surface 32. The upper surface and lower surface can be parallel to one another. A board engaging surface 33 can be defined between the upper surface 31 and lower surface 32. This board engaging surface can be rounded, for example, circular and/or elliptical. Of course, the board engaging surface 33 can include different flat or planar facets which can be angled relative to one another. As shown, the board engaging surface can be of a curved configuration so that it can readily engage and smoothly slide along the surface of the board being engaged thereby, effectively facilitating pushing of the board in a desired direction. Optionally, the outer perimeter of the pusher cam can be of a circular or cylindrical form.

The pusher cam can be joined with the base 20 and movable relative to the base 20. For example, the pusher cam 30 can be rotatable in a clockwise or counterclockwise manner about the first pivot axis A1 as shown in FIG. 2. This pivot axis can correspond to a bolt, screw, pin, bar, axle or other fastening element that joins the pusher cam 30 to the base.

The pusher cam 30 can be located adjacent an upper surface 21 of the base. The pusher cam can be located at a first end 24 of the base which is located opposite the second end 25 of the base 20. Optionally, the pusher cam can be located above the base. The pusher cam 30 can be joined with a lever 40. The lever 40 can be fixedly and immovably joined with the pusher cam with fasteners, welds, cement and other joining mechanisms. Alternatively, the pusher cam and lever can be integrally formed as a single part. The lever 40 can include a center line CL. This center line CL can pass through or generally be aligned with the first pivot axis A1. Of course, if desired, the lever 40 can be offset relative to the first pivot axis A1 as desired. The lever can also be elevated a preselected distance D1 relative to the upper surface 31 of the pusher cam. This distance D1 can be optionally 0" to 6", further optionally ⅛" to 4" and even further optionally ¼" to 2". This can provide additional clearance above a board or other structure being pushed with the pusher cam 30. If desired, the lever 40 can include a handle 42 which can include padding, cushion or some other ergonomic structure to enhance manual gripping of the lever by a user.

As shown in FIGS. 1-3, the base 20 can include an upper surface 21 and an opposite lower surface 22. As illustrated, the base 20 can include a first section 26 and a second section 27. The pusher cam can be joined with the first section 26, above the upper surface 21. The joist cam 50 can be joined with the bottom of the first section 26, under the lower surface. The joist cam 50 can be disposed a preselected distance D4 below the lower surface 22 of the second section 27 of the base 20. This distance D4 can correspond to a sufficient distance below the upper surface 3U of a joist 3 upon which the carpentry tool 10 is placed. The distance D4 from the lower surface 22 of the base 20 can form a gap. This gap can be optionally ¼" to 1", further optionally ½" in height, depending on the particular application and the type of joist cam utilized. With this placement below the upper surface of the joist, the cam 50 can better bite into, grip or otherwise engage the side surfaces of the joist as described below. In alternative embodiments, the first section 26 and second section 27 can be parallel and aligned with one another, rather than offset vertically relative to one another by the distance D4. In such a case, the joist cam 50 can be increased in vertical height so that more of the outer perimeter 53 of the joist cam can engage the joist.

Returning to the embodiments shown in FIGS. 1-3, the joist cam 50 can be joined to the base 20 with a fastener 51. The fastener 50 can be in a form of a bolt, screw, rivet, fastener, pin or other element. The joist cam 50 can be rotatable about the second pivot axis A2. The second pivot axis A2 can be distal from the first pivot axis A1 of the pusher cam 30, optionally by a distance D3, which can be optionally about ¼" to 6", further optionally ½" to 2". Alternatively, the axes A1 and A2 can overlap so they are aligned with and generally correspond with one another, with the pusher cam rotatable about the same axis as the joist cam.

As illustrated in FIGS. 1 and 3, the joist cam 50 can include a lower surface 54 and upper surface 55. The upper surface 55 can face the lower surface 22 of the base 20, and as mentioned above can be offset by a distance D4 relative to the same. The joist cam 50 can include a joist engaging surface or perimeter 53 that is configured to engage a joist. This perimeter 53 can include one or more teeth, projections or other surfaces (such as knurling) 56 that assist in enabling the cam to bite into and/or grip a joist.

The perimeter of the joist cam can be rounded, however, as with the pusher cam, this surface can be elliptical, curved or can include multiple planar facets angled relative to one another, depending on the desired leverage and rate of force applied through the joist cam 50 to an underlying joist. Optionally, the outer surface of the joist cam can be of a circular or cylindrical form.

The tool 10 can include a second joist engagement element 60. This second joist engagement element 60 can include a joist base element 63 that extends downwardly from the lower surface 22 of the base 20 a preselected distance D5. As shown in FIG. 2, this distance D5 can establish another gap between the lower surface 22 of the base 20 and the blade or plate 64 of the element 60. This distance D5 can be optionally 0" to about 3", further optionally ⅛" to 1", depending on the particular application. This too can ensure that the forces applied by the blade or plate 64 against a joist are vertically downward and/or generally distant from the upper surface 3U of the joist 3.

The joist base element 63 can be joined with the blade or plate 64. The blade or plate 64 can include an edge or knife 66 that faces inwardly toward the joist recess JR as shown in FIG. 2. A joist is placed in the joist recess JR during operation of the tool 10. The blade or plate 64 can include a first end 61 and a distal, opposite second end 62. Optionally, the first end 61 can extend beyond the front edge 28 of the base 20. Further optionally, the second end 62 can extend beyond the rearward edge 29 of the base 20. In this manner, the length of the element 60 can be greater than the overall width of the base 20 from the front edge 28 to the rear edge 29. This increased distance and the general elongated configuration of the element 60 from end to end, can provide added stability to the tool when the blade or edge 66 engages a joist to prevent tipping or rocking of the tool relative to the same. The blade or edge 66 as illustrated can be configured so that it is horizontal when the tool is in use. Optionally, it can extend in a plane that is perpendicular to the first and second axes A1 and A2, or generally parallel to a plane within which the joist cam 50 rotates. Alternatively, the blade or edge 66 can run vertically, parallel to the axes A1 and/or A2 and transverse, for example perpendicular, to the plane in which the joist cam 50 rotates.

Figure 11:
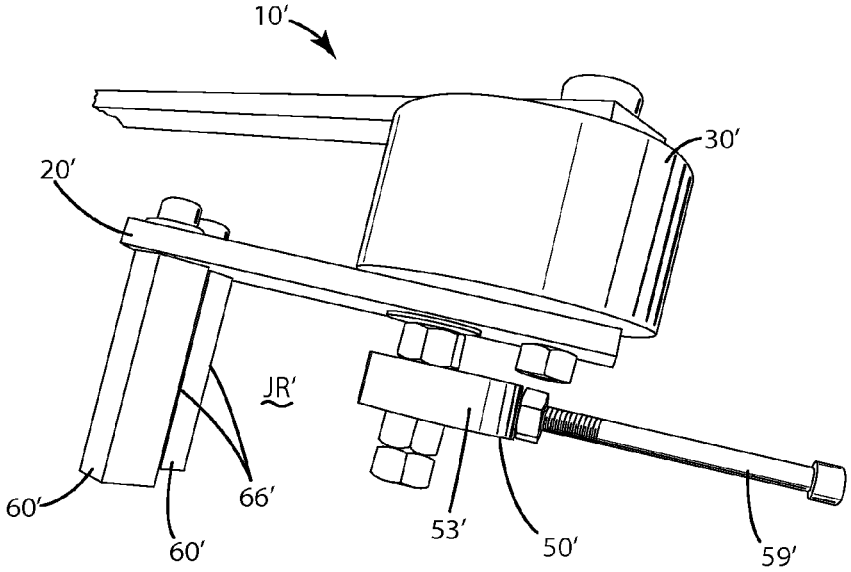
FIG. 11 is a perspective view of a first alternative embodiment of the carpentry tool.

The joist recess JR shown in FIG. 2 is established between the outer perimeter 53 of the joist cam 50 and the blade or edge 66 of the second joist engaging element 60. This joist recess JR can be of a satisfactory height and width to accommodate a variety of different sized joists. In one example, the joist recess JR is of a variable dimension or width. As shown in FIG. 1, that dimension is dimension D which can be optionally 2" to 6", further optionally 2" to 4". Rotating the joist cam 50, however, can reduce the dimension and width of that joist recess JR to distance D2 shown in FIG. 2, which can be 1½" or less, that is, is the standard width of most conventional wood joists. In turn, the joist cam can pinch, grip or otherwise bite the joist at its upper regions to enhance the gripping of the tool relative to the joist. This type of vertically disposed blade or edge is illustrated in the alternative embodiment of FIG. 11. There, the tool 10' includes two joist engaging elements 60' that are generally parallel with one another and include edges or blades 66' that are parallel to one another and disposed immediately adjacent the joist recess JR'. In this embodiment, the blades or edges 66' can be vertical and can extend transverse or perpendicular to the plane within which the joist cam 50' rotates. In this embodiment as well, the joist cam 50' can include a smooth outer perimeter 53'; but can also include a joist cam lever 59'. With this lever, a user can effectively lock the joist cam into engagement with the joist before the pusher cam and lever are engaged to push against a board. In this manner, the entire tool, the base 20', joist cam 50' and second joist engaging element 60' can all be clamped or otherwise fixed relative to a joist before the pusher cam 30' is rotated.

As illustrated in FIGS. 1 and 2, the tool 10 can also include a locking element 70. The locking element can be concentrically disposed about the first pivot axis A1. The locking element can include a threaded portion that threads into a receiver that lays along the first pivot axis A1. In so doing it can compress the locking element, and in particular the locking nut 71, against the upper surface 31 of the pusher cam 30. This effectively locks the pusher cam 30 in a fixed spatial orientation relative to the base 20. Although shown as a threaded locking element associated with a pivot axis, the locking element 70 could be external to or removed from the pusher cam 30. For example, it could be joined directly with a base 20 and include an arm that interfered with movement of the pusher cam 30 to secure the pusher cam in a fixed spatial orientation relative to the base.

The tool 10 can be utilized by a user to move and/or align a first board with a second adjacent board. This can be better understood with the method of operation as described below in connection with FIGS. 4-7. Beginning with FIG. 4, the tool 10 is placed adjacent a first board 1 and a second board 2. The first board 1 may include a gap G distanced from the second board 2. This gap G may be caused by the first board 1 being warped, misshapen or otherwise deformed. The tool base 20 is placed over the upper surface 3U of the joist 3. The upper portion of the joist 3 is specifically placed within the joist recess JR. The joist cam 50 is positioned on the left side L of the joist 3 and the second joist engaging element 60 is placed on the opposite side of the joist 3. These elements can be disposed a preselected distance below the upper surface 3U of the joist as explained above.

Figure 4:
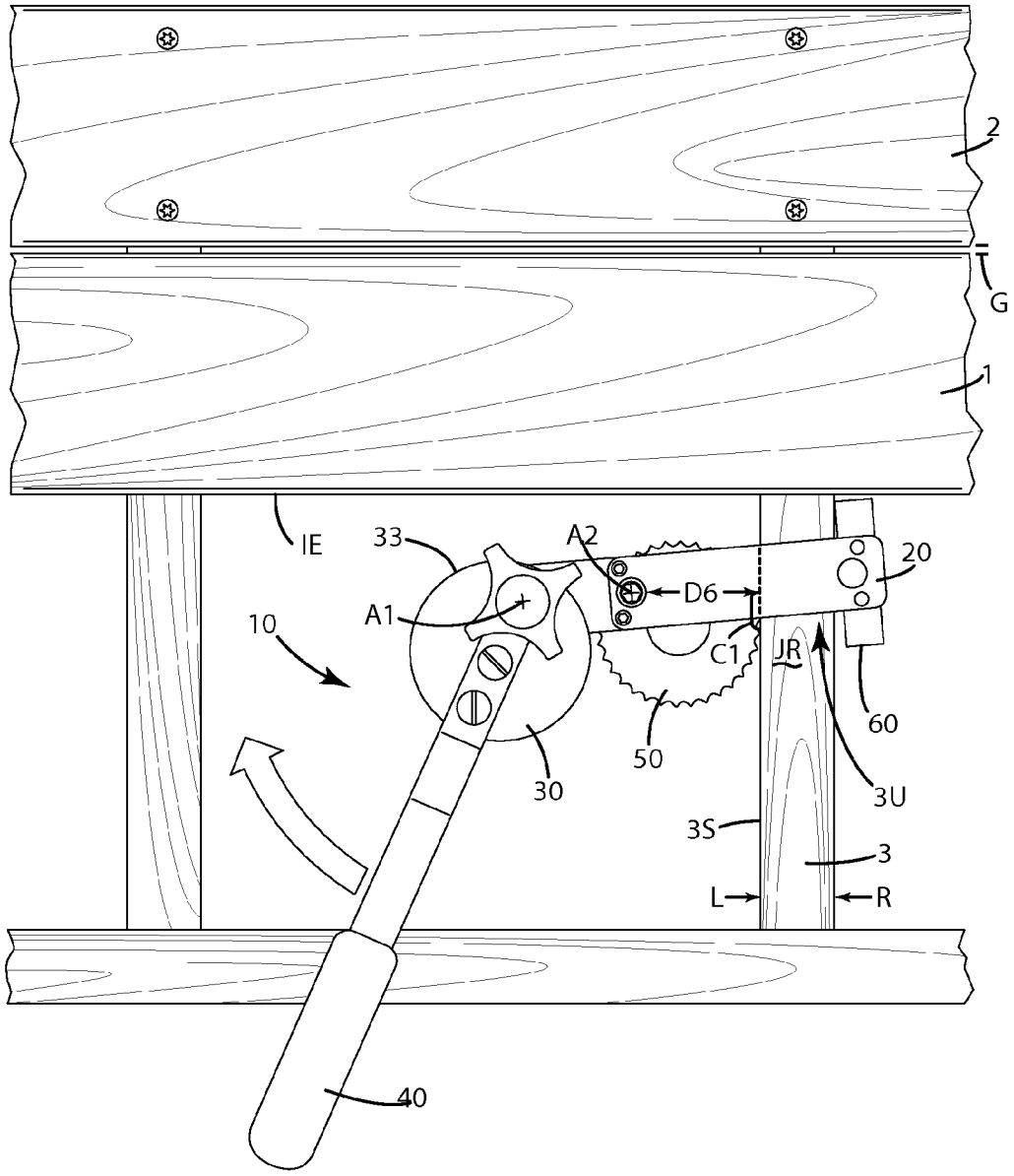
FIG. 4 is a top view of the carpentry tool initially engaging a joist and set up to push a first board toward a second board.

As shown in FIG. 4, a user moves the lever 40 in the direction of the arrow. This movement rotates the pusher cam 30 so that the engagement surface 33 engages the side or edge 1E of the first board 1. This rotation of the lever 40 also rotates the pusher cam about the axis A1. In this manner, the pusher cam rotates relative to the base 20. As shown in FIG. 4, the joist cam 50 includes a first contact region C1 at which the joist cam 50 engages the side surface 3S of the joist 3. The contact region C1 is disposed a distance D6 from the pivot axis A2 upon initial activation and gripping of the joist 3. As the joist cam rotates and "rolls" along the joist 3, a different contact region C2 contacts the joist. The region C1 no longer contacts the joist. The second region C2 is a greater distance D7 from the second pivot axis A2 than the first region C1 was at distance D1 from the second pivot axis A2.

Figure 5:
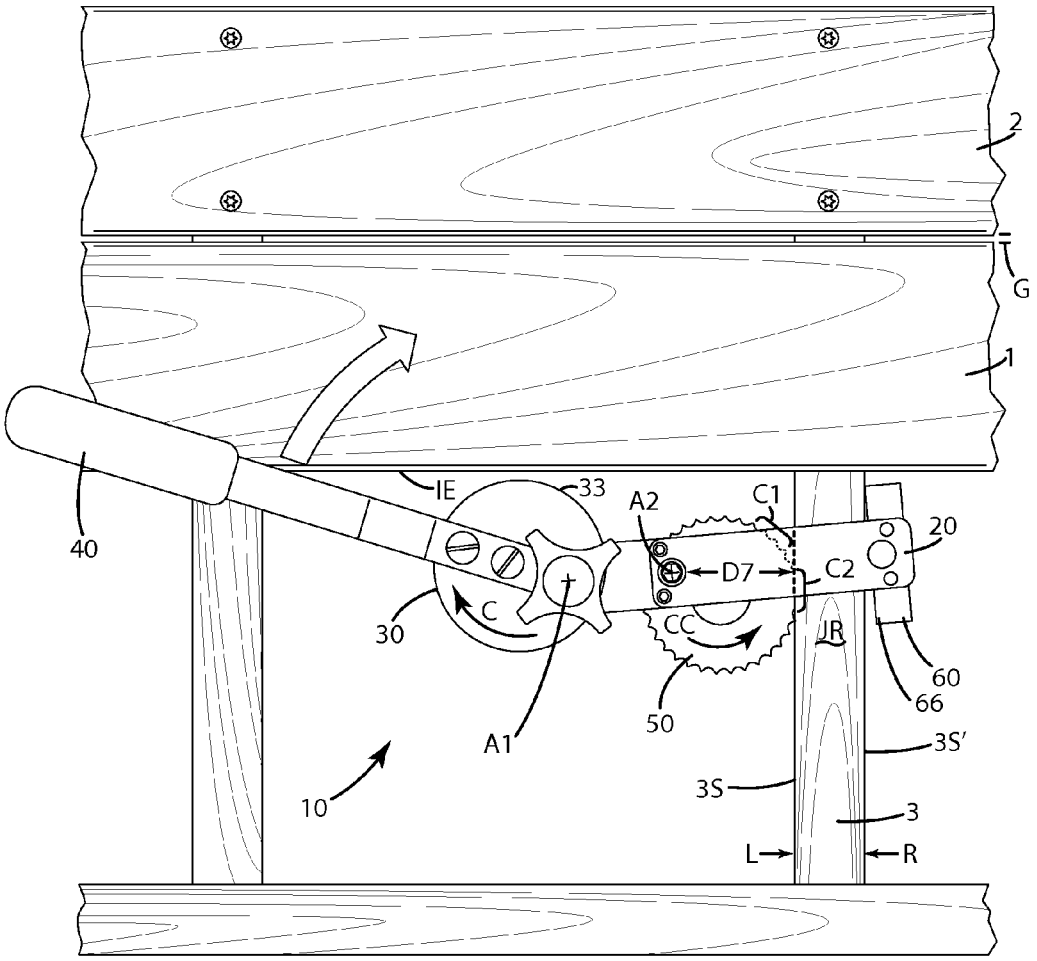
FIG. 5 is a top view of the carpentry tool with a pusher cam engaged against the first board to push it.

Referring to FIG. 5, the rotation of the lever 40 of the tool 10 continues. This brings the board engaging surface 33 of the pusher cam 30 in more close relationship with the side surface 1E of the first board. In turn, this surface begins to slide along and push the board 1 toward the second board 2. During this rotation, the pusher cam 30 rotates in a first direction about the first pivot axis A1. Simultaneously, the joist cam 50 rotates about the second pivot axis A2 in an opposite direction about the second pivot axis A2. As the pusher cam 30 rotates in its direction C about the first pivot axis A1, this movement and the engagement of the joist cam 50 against the joist 3, causes the joist cam 50 to rotate in the direction CC about the second pivot axis A2. Rotational direction C can be the opposite of the rotational direction CC. Thus, the pusher cam and joist cam can rotate in opposite directions simultaneously as the tool engages the board. The rotation of the joist cam 50 also causes the dimension of the joist recess JR, that is, its width, to decrease from D to D2 in relation to FIGS. 1 and 2. This causes the joist cam and its outer perimeter, and in particular the optional teeth or knurling, to grip or bite into the side surface of the 3S of the joist 3. Simultaneously, the blade or edge 66 of the second joist engaging element 60 also engages and bites into the opposing side surface 3S' of the joist 3. With the biting of the joist cam 50 on one side of the joist and the other element 66 on the opposite side, the base can be impaired or prevented from tipping or rocking or otherwise moving as the pusher cam 30 moves the first board 1.

Figure 6:
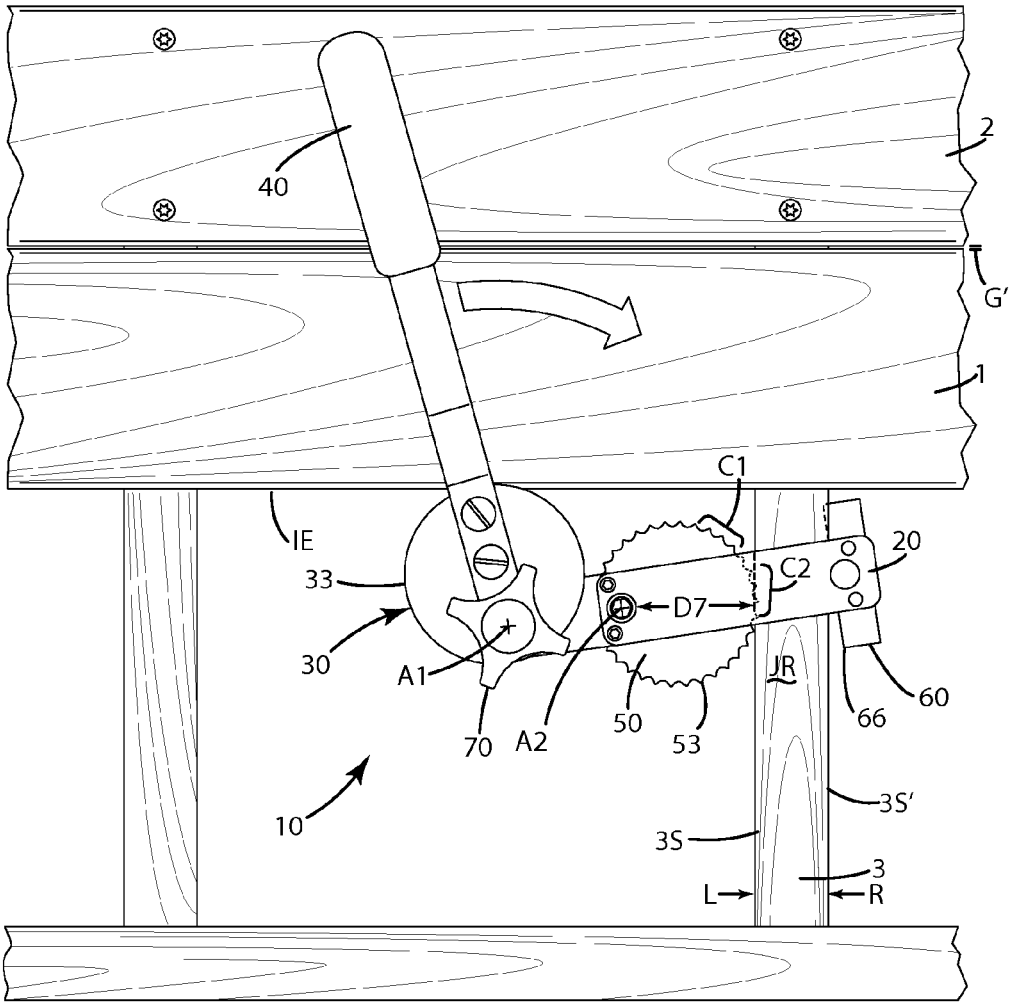
FIG. 6 is a top view of the carpentry tool pushing the first board adjacent the second board, with the joist cam engaging a joist.

As shown in FIG. 6, the tool has established a desired gap or preselected distance G' between the first board and the second board. Of course this gap can be selected and established by rotating the lever and pusher cam in preselected increments. In this manner, the tool can provide dynamic adjustment of that gap G, G' to a variety of dimensions. This can provide exceptional and precise spacing between the relevant boards.

As shown in FIG. 6, the pusher cam 30 and in particular the outer perimeter 33 is fully engaged and pushed the edge or side 1E of the first board 1. The joist cam 50 and its outer perimeter 53 is fully engaged and locked into the side surface 3S of the joist 3. The blade 66 also is engaged, gripping or biting into the opposite surface 3S'. The joist remains in the joist recess JR between the joist cam 50 and the second joist engaging element 60, that is, the blade or edge 66.

Figure 7:
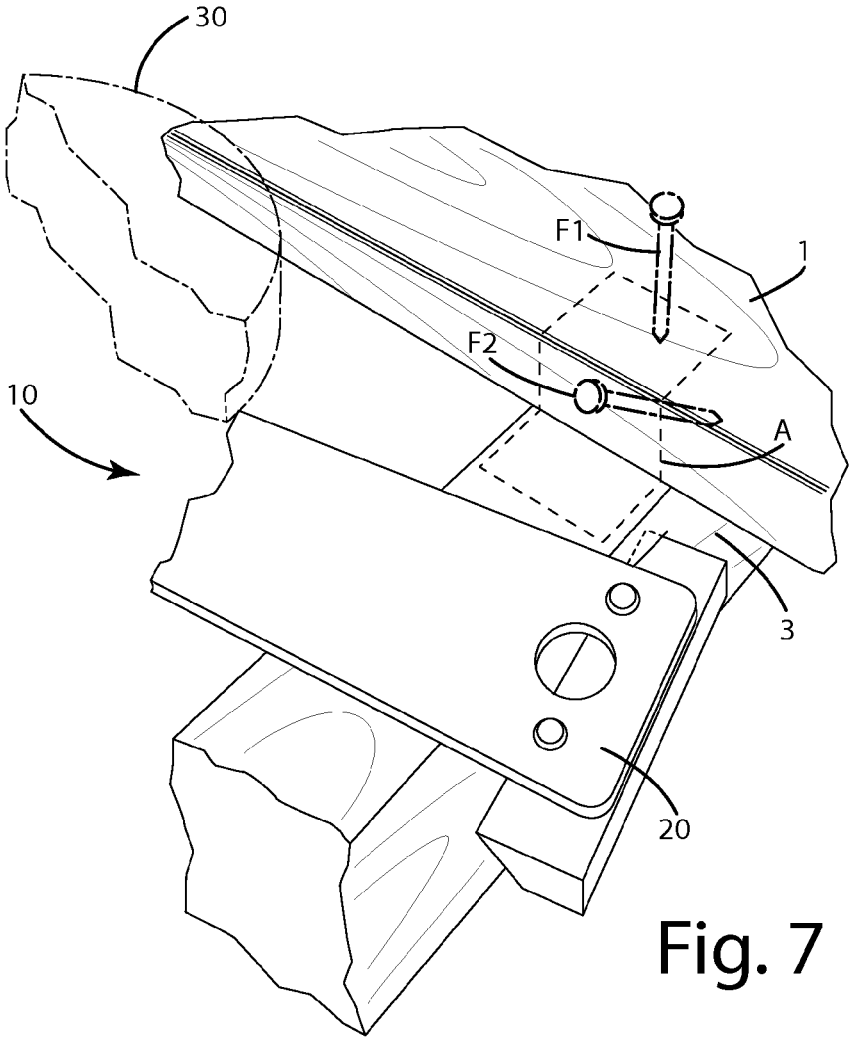
FIG. 7 is a perspective view of an area that remains unobstructed by the carpentry tool to accommodate a fastener in the first board and/or underlying joist.

At this point, the pusher cam and lever can be fully rotated to a locked position, where the configuration of the tool can hold the board in place without the user having to apply a force to the lever. Optionally, the locking element 70 can be locked down to hold the tool in fixed position relative to the first board 1, and thus the first board 1 relative to the second board 2. In either of the foregoing, the user can take either one or both hands off the tool, while the locking element locks the tool in place, or full rotation of the tool holds it in the locked position. When the tool is locked, the user can use one or both hands to install a fastener F1 or F2 as shown in FIG. 7. The fasteners can be installed in the area A, which remains open adjacent the side edge and/or upper surface of the joist 3U even when the tool is fully installed. The area A can vary in size depending on the particular application. With this area A open, the fasteners F1 and/or F2 can be installed quickly and efficiently without the tool or its components obstructing or interfering with that activity.

Figure 8:
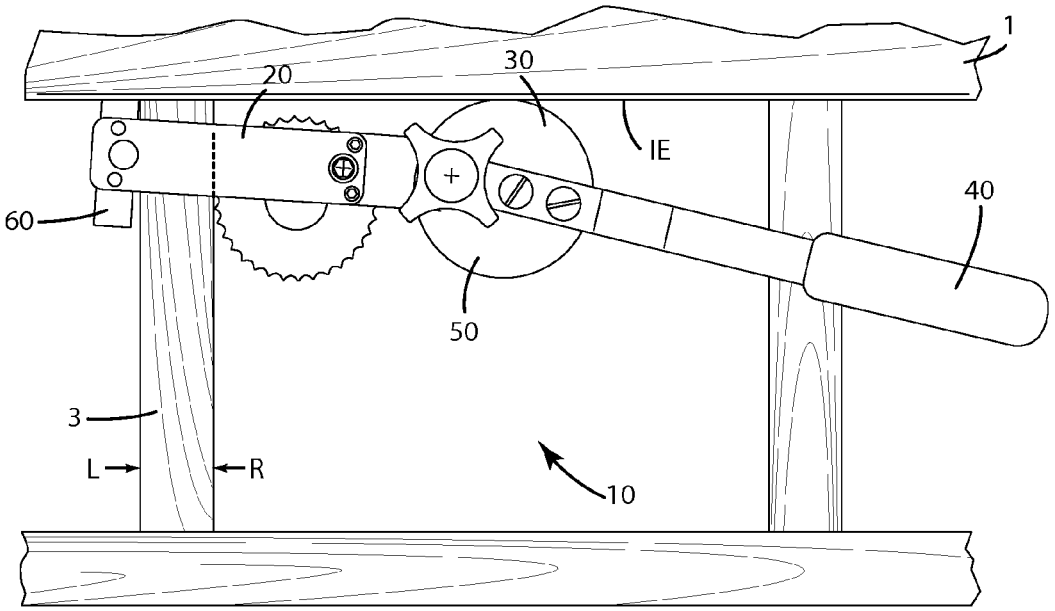
FIG. 8 is a top view of the carpentry tool reversed and installed on an opposite side of a joist.

As explained above, in FIGS. 4-6, the tool 10, and in particular the joist cam 50 engages the joist to the left L of the joist. The current construction of the tool 10, however, is universal and reversible. For example, as shown in FIG. 8, the tool can be reversed so that the joist cam 50 engages the right side R (versus the left side L) of the joist 3. With this inherent reversibility of the tool 10, it can be used in various locations when installing boards. When approaching a corner or wall adjacent the installed deck, floor or other structure, the user can select whether to engage the left or right side of the joist, depending on the space constraints for the lever 40 to be moved. For example, if there is a wall within a small distance, for example, 1" to about 20" located to the right of the joist 3, the user can install and use the tool on the left side L of the joist 3. The user can reverse the tool and use it as shown in FIG. 8 so that the joist cam 50 engages the right side R of the joist 3 in other situations.

Figure 9:
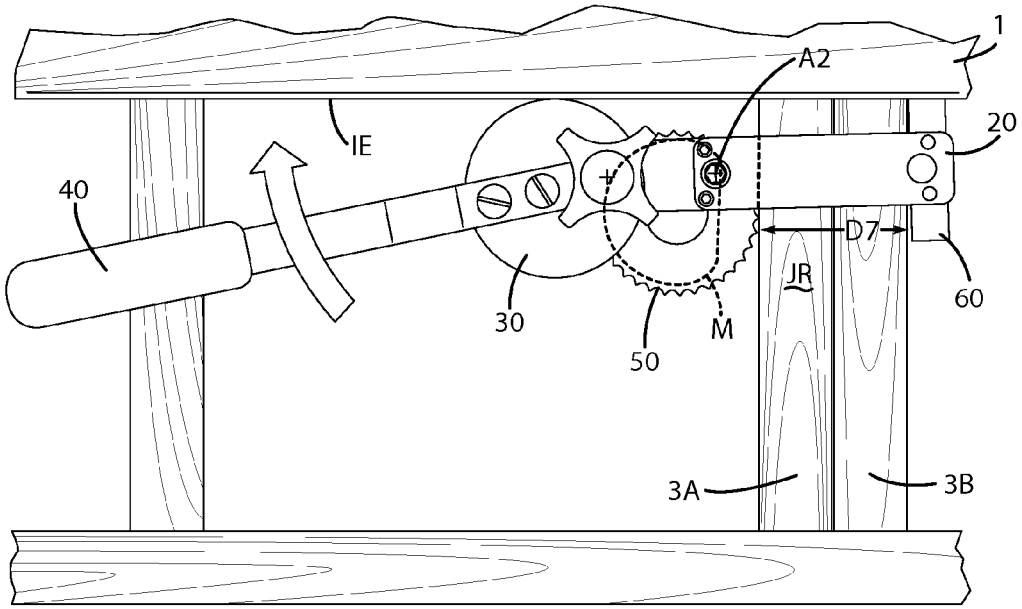
FIG. 9 is a top view of the carpentry tool installed relative to a double joist, with the joist cam and secondary joist elements still accommodating the size of the double joist.
Figure 10:
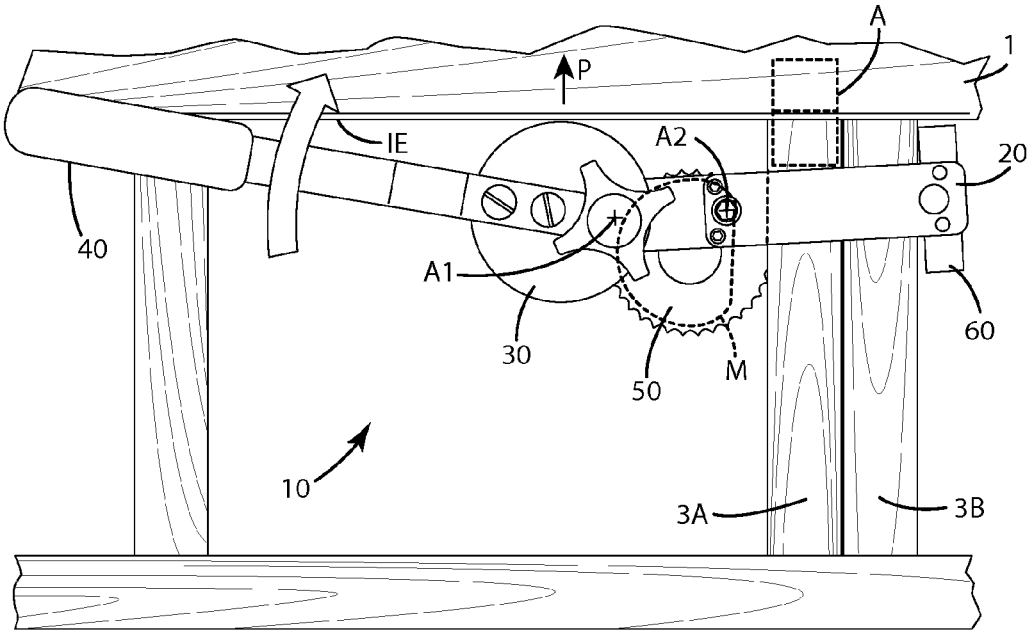
FIG. 10 is a top view of the carpentry tool with the pusher cam pushing against a board, and the joist cam and secondary joist engagement element engaging the double joist.

The tool of the current embodiments also optionally can have the ability to accommodate multiple joists, for example, at least two joists 3A and 3B disposed immediately adjacent one another. Double, triple or quadruple joists can be used where extra support is desired for a deck, floor or other substructure for extra reinforcement thereof. In such a case, the tool 10 can be utilized in a particular manner to accommodate the multiple joists 3A and 3B in the joist recess JR. As shown in FIG. 9, the joist cam 50 can be rotated rearwardly, generally toward the lever 40 and/or pusher cam 30. Optionally, a majority M of the joist cam 50 can be disposed to the left of the second pivot axis A2. The majority of the joist cam can range from about 51% to about 75%, optionally about 51% to about 90% of the total area and/or structure of the joist cam 50. A minor portion of the joist cam 50 can be disposed to the right of the second pivot axis A2, generally facing toward the joist recess JR. With the majority of the joist cam rearward of the second axis A2, distance D7 between the secondary joist engaging element 60 and the joist cam 50 can be of a relatively large. This distance can range from optionally 1½" to 3", further optionally 1½" to 4½", and even further optionally about 1½" to 6", depending on the number of joists and configuration of the tool 10. In this configuration, the tool 10 can operate similar to the way it operates when only one joist is located within the joist recess. For example, with reference to FIGS. 9 and 10, the user moves the lever 40 in the direction of the arrow as shown. Pusher cam 30 engages the board edge or side 1E to push the board 1 in a desired direction. The joist cam 30 engages the first joist 3A while the second joist engaging element 60 engages the second joist B. The first joist 3A and second joist 3B are located between these components within the joist recess JR. Again, due to the variability of the distance D7 between the second joist element 60 and the joist cam 50, the tool can accommodate these double joists. The user continues to rotate the lever 40 in the direction of the arrow as shown in FIG. 10. This further engages the pusher cam 30 against the board edge 1E. The tool and pusher cam 30 thus move the board 1 in the direction P as shown in FIG. 10.

The movement is continued until the first board is a preselected distance from the second board to establish a preselected gap. As with the construction above, the tool is configured so that the base 20 and other components do not interfere or obstruct the area A within which one or more fasteners can be installed through the board 1 and/or into the joists 3A and/or 3B.

A second alternative embodiment of the carpentry tool and a related method are illustrated in FIGS. 12-16, with the carpentry tool generally designated 210. This embodiment is similar to the embodiments described above in structure, function and operation, with several exceptions. For example, the carpentry tool 210 includes a base 220 to which a pusher cam 230 is rotatably attached. A primary lever 240 extends from and is generally attached to the pusher cam 230. A joist cam 250 is joined with the base 220 opposite the secondary joist engaging elements 260, across a joist recess JR'''. The pusher cam can be configured similar to the construction of the embodiments described above, optionally including a cylindrical or round outer perimeter 230R. The pusher cam can be rotatable about an axis A1'. Axis A1 is distal from an axis of rotation A2' of the joist cam 250. The pusher cam 230, however, can be void of any type of locking element, as was present in the embodiments above. Of course, if a locking element is desired, one can be included.

The base 220 in this construction is different from the above embodiments in that it is a solid unitary planar piece. The base generally can include a longitudinal axis LA' which bisects it into first and second equal halves along its length. The axes A1' and A2' of the respective pusher cam 230 and joist cam 250 can be disposed along its longitudinal axis LA', aligned with one another.

Figure 13:
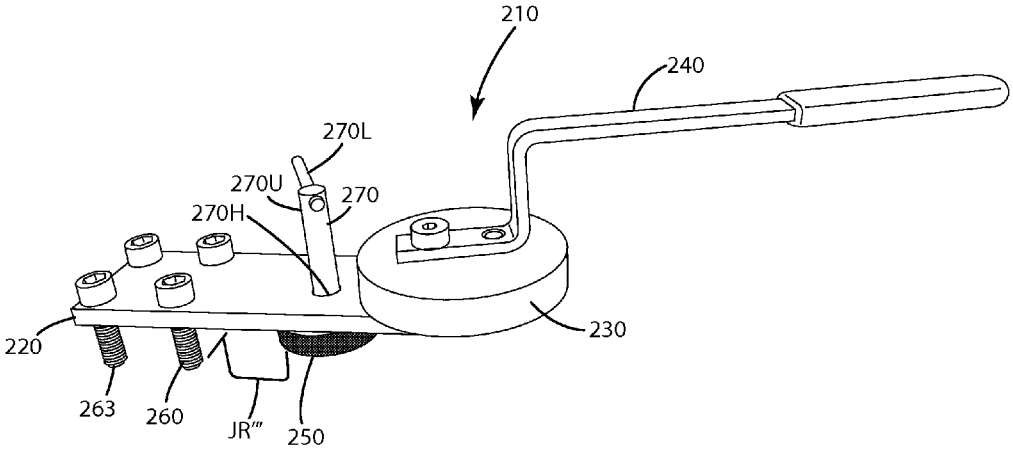
FIG. 13 is an upper perspective view of the second alternative embodiment of the carpentry tool.

In this construction, the joist cam 250 can be in the form of a short cylindrical projection or wheel. This wheel can be joined with an orientation element 270 which can be in the form of a pin or an axle. This pin or axle can project upwardly through the base 220 as shown in FIG. 13, generally through a hole 270H. In this manner, the orientation element 270 can project from the lower surface 232 upwards toward the upper surface 231 on the opposite side of the base 220. The axle 270 can be rotatably mounted in the hole 270H. The portion above the upper surface 231 of the base 220 can be of an enlarged dimension, for example, a diameter greater than that of a portion that extends through the hole 270H. The joist cam 250 can be joined adjacent and under the lower surface 232 to the axle 270. This cam can be of a larger diameter or dimension than the portion of the axle extending through the hole 270H as well. Thus, the axle can be effectively trapped and retained within the hole 270H so that it cannot slide outward but still can rotate within a hole 270H. Optionally, the upper end 270U of the axle 270 can include a manually graspable element 270L. As shown, this element can be in the form of an elongated secondary lever. This secondary lever can be fixedly joined with the upper end 270U of the orientation element 270. Although shown as a secondary lever, this grasping element can be reconfigured in the form of a wheel, a bar, or other structure so that a user can manually rotate the axle 270.

The axle 270 also is positioned to project upward from the base adjacent the pusher cam. Indeed, the axle 270 can be disposed along a path of movement of the pusher cam so that the axle interferes with and limits rotation of the pusher cam. Optionally, the axle can be located so the perimeter of the cam 230 engages the axle (FIG. 16), thereby stopping further rotation of the pusher cam.

Figure 12:
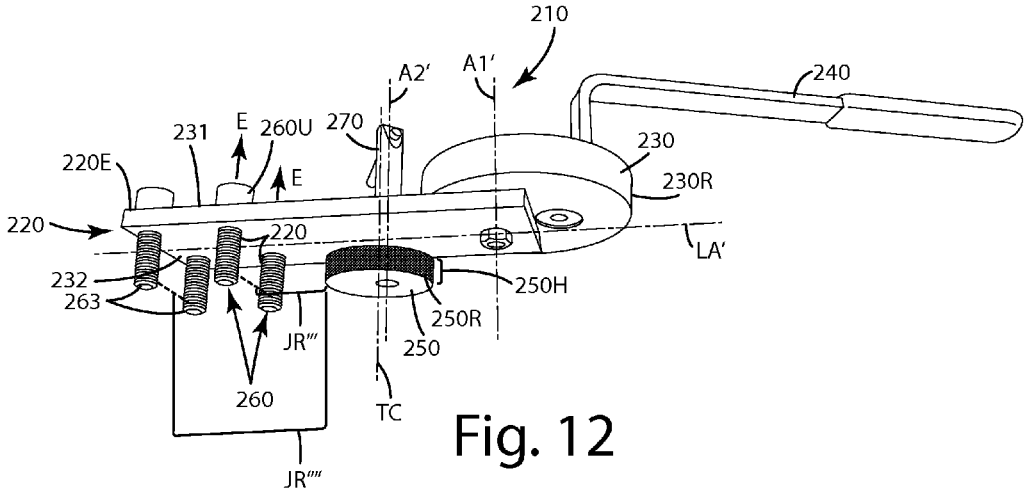
FIG. 12 is a lower perspective view of a second alternative embodiment of the carpentry tool including a modified joist cam and a secondary joist engagement element.

As shown in FIG. 12, the joist cam 250 can be in the form of a short cylinder. The outer perimeter 250R of the cam can be knurled or otherwise surface treated to provide additional friction between the joist cam 250 and a joist disposed in the joist recess JR'''. Generally, the axis of rotation A2' of the joist cam 250, and also the axle 270 can be offset from the true center of the cylindrical or circular body 250 of the joist cam 250.

As shown in FIGS. 12 and 13, the joist cam 250 can be of a depth or height 250H. This depth or height can generally be sufficient to engage the side of a joist and bite into it, similar to embodiments above. Opposite the joist cam 250 are secondary joist engaging elements 260. As illustrated, these elements can be in the form of threaded fasteners such as bolts. The threaded fasteners can include a knurled upper region 260U which can be manually graspable by a user. The base 220 can also include threaded holes 220H that engage the threaded portions of the secondary joist engaging elements 260. A user can grasp the upper portions 260U of the elements 260 and rotate them so that they move in the direction E as shown in FIG. 12. This movement effectively removes the secondary joist engaging elements 260 from the lower surface 232 of the base 220. In this manner, the joist recess JR''' enlarges an area and width to the enlarged joist recess JR''''. This enlarged recess JR''' can be about 1½ to 4, and optionally double the size of the recess JR''' when the secondary fastener elements 260 are extending below the lower surface 232.

The enlarged joist recess JR'''' is generally defined between the same outer surface or perimeter 250R of the joist cam 250 and the tertiary joist engaging elements 263 that are disposed closer to the end 220E of the base 220 than the secondary joist engaging elements 260. These tertiary joist engaging elements 263 can be of the same configuration as the secondary joist engaging elements. Of course, if desired, they can be replaced with a solid projection or wall that is non-removable from the base, depending on the particular application. With this variability in the size of the joist recesses JR''' to JR'''', a user can easily and rapidly convert the tool from one that can accommodate a single joist in joist recess JR''', to one that can accommodate a double joist in the enlarged joist recess JR''''. To convert back, a user simply threads joist engaging elements 260 back through the base 220 so that they extend through and below the lower surface 232.

Figure 14:
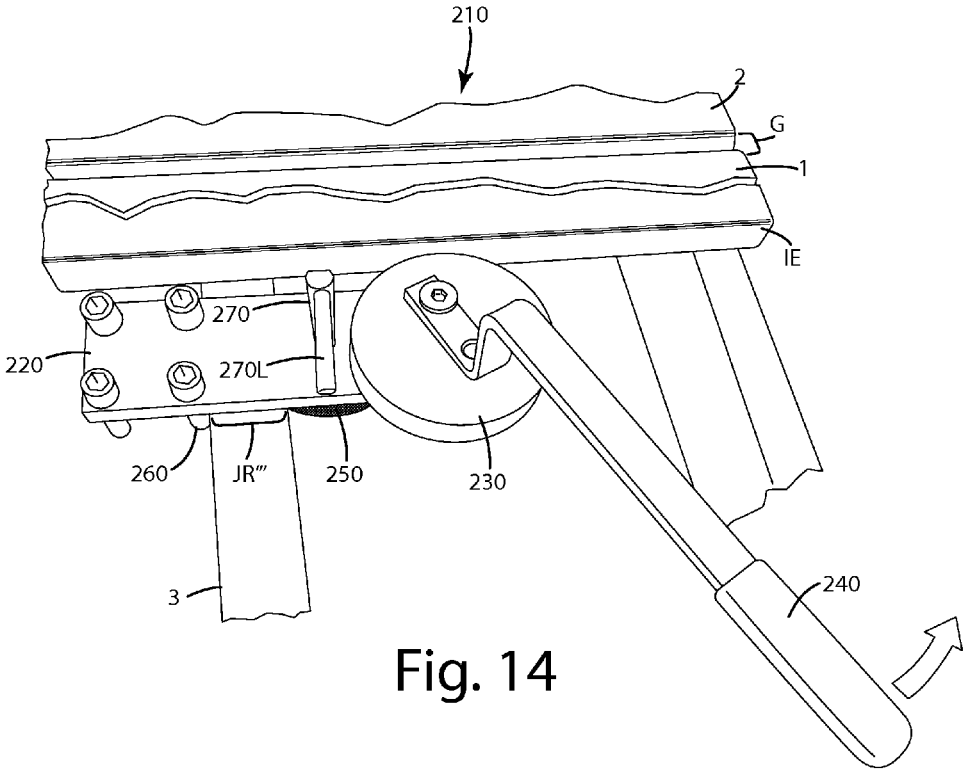
FIG. 14 is a perspective view of the carpentry tool of the second alternative embodiment initially engaging a board and a joist.

Operation of the second alternative embodiment of the carpentry tool 210 is similar to that of the embodiments described above. For example, as shown in FIG. 14, the carpentry tool 210 is installed initially on the joist 3. The joist 3 fits within the joist recess JR''' of the tool 210, between the secondary joist engaging element 230 and the joist cam 250. The base 220 is moved so that the pusher cam is initially engaged against the interior edge IE of board 1. The user rotates the primary lever or handle 240 in the direction shown by the arrow, generally counter clockwise in the configuration illustrated. This pushes the outer perimeter 230R of the pusher cam 230 against the interior edge IE of the board 1, causing the board 1 to deflect and/or move closer to the next adjacent board 2.

When the pusher cam 230 rotates counter clockwise, this creates a moment about the axis A2'. This causes the joist cam 250 to rotate relative to the base, and generally in an opposite direction, for example, clockwise. This, in turn, squeezes the joist between the joist cam 250 and the secondary joist engaging elements 260.

Figure 15:
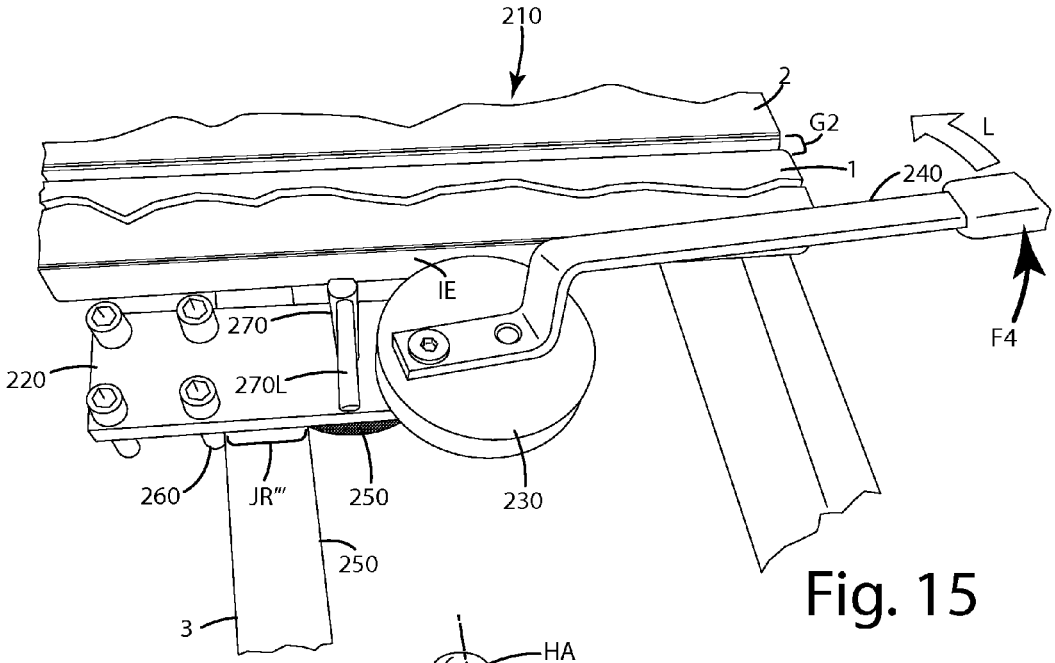
FIG. 15 is a perspective view of the carpentry tool of the second alternative embodiment further engaging and pushing the board toward another board.

As shown in FIG. 15, the user continues to apply force F4 to move the lever 240 in direction L. This increases the amount of force by the pusher cam 230 against the interior edge IE and thus the board 1. This also pushes the board even farther, into more close proximity to the board 2. For example, as shown in FIG. 14, the first board 1 initially can be separated from the second board 2 by a gap G. This gap G can be large or small depending on the warpage and/or straightness of the boards 1 and/or 2. Generally, it is desired that this gap G be minimal or uniform along the length of the board. As shown in FIG. 15, the force F4 applied to the lever 240 further engages the pusher cam 230 against the board 1. This, in turn, reduces the size of the gap G to smaller gap G2 which is less than gap G. As further shown in FIG. 16, the pusher cam 230 is used to push the board and reduce the gap to gap G3. The gap G3 is substantially less than the gap G and/or G2 shown in FIGS. 14 and 15. Optionally, a gap G3 can be about 0 inches to about ½ inch, further optionally about ⅛ inch to about ¼ inch, depending on the particular application and desired size gapping between respective boards.

Figure 16:
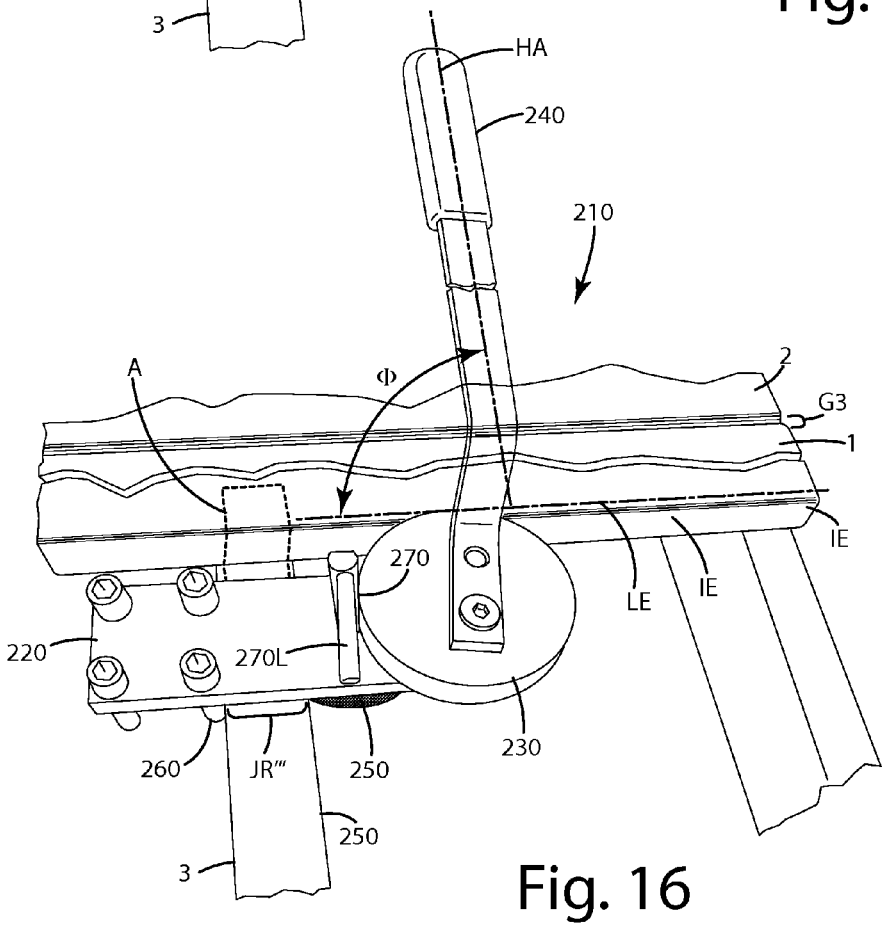
FIG. 16 is a perspective view of the carpentry tool of the second alternative embodiment, with a pusher cam engaged against the board at a sweet spot along the perimeter of the cam, and the pusher cam engaged against an orientation element to limit rotation of the pusher cam.

As shown in FIG. 16, the base continues to rotate the lever 240 so that its axis HA is generally perpendicular to the longitudinal edge LE of the board 1. This angle can be approximately 90° or more. In turn, this can enable the pusher cam to achieve its "sweet spot" against the board 1 without the user having to manually hold the tool in the orientation as shown in FIG. 16. In this manner, a user can utilize other tools to install fasteners or screws through the board 1 and thereby fasten it in place.

As with the embodiment above, the tool 220 is configured to establish an area A' between the base 220 and the interior edge IE of the board 1. With this area provided, a user can readily and easily access it and install a fastener through the interior edge of the board 1, thereby permanently fastening it adjacent the board 2.

After the board 1 is fastened down, the tool can be removed by rotating the primary lever 240 clockwise. This disengages the pusher cam 230 from the interior edge IE of the board 1. With this force removed, the rotational force on the joist cam 250 is also reduced so that the joist cam no longer pinches the joist 3 in the joist recess JR'''. After this force is removed, the tool 220 can be removed from the joist and applied to another joist to continue the operation of fastening down the first board 1.

Optionally, the tool 220 can be configured so that it is reversible for left hand or right hand operation, and/or other progression along a particular board. For example, as shown in FIG. 16, the tool can be configured for right hand use, going from left to right across the figure relative to the board 1. If an operator desires to make the tool left hand operated or proceed from the right side to the left side of FIG. 16 along the board 1, the user can simply rotate the handle 180° and flip the base 220 end for end, so that the pusher cam 230 is located on the left side of the joist 3 and the secondary joist engaging elements 260 are located on the right side of the joist 3. The user can then rotate the handle 240 in a clockwise manner to engage the board 1 and push it toward the other board 2 in a manner similar to that described above. This causes the joist cam 250 to rotate in a counter clockwise manner upon the exertion of a moment generated by the pusher cam 230 rotating and engaging against the base 220.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A carpentry tool comprising:

a base including an upper surface and a lower surface, the lower surface configured to face toward an underlying joist;

a pusher cam joined with the base above the upper surface, the pusher cam being rotatable about a first pivot axis, the pusher cam including a board engaging surface adapted to engage a board;

a lever immovably and fixedly attached to the pusher cam, the lever configured to enable a user to mechanically rotate the pusher cam about the first pivot axis so as to forcibly engage the board engaging surface with the board;

a first joist engaging element extending downwardly from the lower surface of the base;

a second joist engaging element extending downwardly from the lower surface of the base, distal from the first joist engaging element so that a joist recess is formed adjacent the lower surface of the base, generally between the first and second joist engaging elements, wherein the first joist engaging element is a joist cam, rotatable about a second pivot axis, the joist cam including a joist engaging surface adapted to engage the joist, where engagement of the pusher cam against the board with a pushing force causes rotation of the pusher cam about the first pivot axis and simultaneous rotation of the joist cam about the second axis, so that the joist recess is reduced in dimension and the joist engaging surface bites into the joist, with the joist cam and second joist engaging element impairing horizontal tipping of the tool upon application of the pushing force, wherein no part of the tool obstructs a fastener application area adjacent an upper surface of the joist upon application of the pushing force so that a fastener can be installed through the board and joist.

2. The carpentry tool of claim 1 wherein the second joist engaging element is a threaded fastener disposed opposite the joist cam across the joist recess within which the joist fits during use of the tool.

3. The carpentry tool of claim 1 wherein the joist engaging surface extends around a perimeter of the joist cam and is configured to bite into the joist.

4. The carpentry tool of claim 1 wherein the joist cam rotates in a direction about the second pivot axis that is opposite another direction that the pusher cam rotates about the first pivot axis.

5. The carpentry tool of claim 4 wherein the joist cam projects downwardly from the lower surface of the base and includes a circular outer perimeter.

6. The carpentry tool of claim 1 wherein the joist engaging surface is configured to roll along the joist when the pusher cam pushes the board.

7. The carpentry tool of claim 6 wherein the joist engaging surface is generally rounded in a region where the joist engaging surface contacts the joist.

8. The carpentry tool of claim 1 comprising an orientation element, joined with the first joist engaging element, wherein the orientation element includes a grasping element, whereby a user can manually grasp the grasping element and rotate the first joist engagement element into engagement with the joist.

9. The carpentry tool of claim 8 wherein the orientation element is an axle joined with a non-central part of the first joist engaging element;

wherein the axle extends through the base, wherein the grasping element is a secondary lever joined with a portion of the axle above the upper surface of the base.

10. A carpentry tool, comprising:

a base, a pusher cam rotatably joined with the base above the base, a joist cam rotatably joined with the base below the base, a lever joined with the pusher cam and adapted to rotate the pusher cam in a first direction, wherein the rotation of the pusher cam in the first direction causes engagement of the joist cam with a joist, rotating the joist cam in an opposite direction, wherein the pusher cam is rotatable about a first axis, wherein the joist cam is rotatable about a second pivot axis, the first axis being distal from but parallel to the second pivot axis.

11. The carpentry tool of claim 10 comprising:

an axle joined with the joist cam, wherein the joist cam is cylindrical, having a circular outer perimeter and a center axis, wherein the axle is offset a distance distal from the center axis.

12. The carpentry tool of claim 11, wherein the joist recess includes a distance between the joist cam and a second joist engagement element, wherein rotation of the joist cam in the opposite direction alters the distance.

13. The carpentry tool of claim 10 wherein the lever is fixedly and immovably joined with the pusher cam.

14. The carpentry tool of claim 10, wherein the joist cam includes an outer perimeter, wherein the joist cam is disposed opposite a secondary joist engaging element to establish a joist recess that is dynamically alterable in width to accommodate a variety of different sized joists.

15. A carpentry tool comprising:

a base, a pusher cam rotatably joined with the base above the base, a joist cam rotatably joined with the base below the base, a lever joined with the pusher cam and adapted to rotate the pusher cam in a first direction, wherein the rotation of the pusher cam in the first direction causes engagement of the joist cam with a joist, rotating the joist cam in an opposite direction, wherein the joist cam is disposed below the base a preselected distance so that a gap is created between a lower surface of the base and an upper surface of the joist cam.

16. A carpentry tool comprising:

a base, a pusher cam rotatably joined with the base above the base, a joist cam rotatably joined with the base below the base, a lever joined with the pusher cam and adapted to rotate the pusher cam in a first direction, wherein the rotation of the pusher cam in the first direction causes engagement of the joist cam with a joist, rotating the joist cam in an opposite direction, an axle extending upward from the joist cam, and a secondary lever joined with the axle;

wherein the axle is manually rotatable via rotation of the secondary lever to set the joist cam against a joist, wherein the axle is adapted to engage the joist cam and selectively limit rotation thereof.

17. A carpentry tool comprising:

a base, a pusher cam rotatably joined with the base above the base, a joist cam rotatably joined with the base below the base, a lever joined with the pusher cam and adapted to rotate the pusher cam in a first direction, wherein the rotation of the pusher cam in the first direction causes engagement of the joist cam with a joist, rotating the joist cam in an opposite direction, wherein the pusher cam is adapted to rotate clockwise about a first pivot axis as the lever rotates the pusher cam, wherein such rotation causes the joist cam to rotate counterclockwise about a second pivot axis.

18. A method for pushing a board near a joist the method comprising:

providing a carpentry tool including a base, a pusher cam having a lever, a joist cam on an opposite surface of the base and a joist engaging element opposite the joist cam to establish a joist recess;

placing the carpentry tool adjacent a board so that the pusher cam engages the board, and so that the joist cam engages the joist;

moving the lever to rotate the pusher cam, thereby pressing the pusher cam against the board;

rotating the joist cam so that the joist cam and the joist engaging element squeeze a joist disposed in the joist recess; and pushing the board with the pusher cam to move the board nearer another board, wherein the pusher cam is rotatable about a first pivot axis, wherein the joist cam rotates about a second pivot axis during the rotating step, the first pivot axis being distal from but parallel to the second pivot axis, wherein the joist cam rotates in a direction during the rotating step about the second pivot axis that is opposite another direction that the pusher cam rotates about the first pivot axis during the rotating step.

19. The method of claim 18 comprising:

maintaining an area above the joist and along a side of the board clear from obstruction with the tool; and installing a fastener in the area, through the board and into the joist.

* * * * *